US007652425B2

(12) United States Patent
Niigaki et al.

(10) Patent No.: US 7,652,425 B2
(45) Date of Patent: Jan. 26, 2010

(54) TRANSMISSION TYPE PHOTOCATHODE INCLUDING LIGHT ABSORPTION LAYER AND VOLTAGE APPLYING ARRANGEMENT AND ELECTRON TUBE

(75) Inventors: Minoru Niigaki, Hamamatsu (JP); Shoichi Uchiyama, Hamamatsu (JP); Hirofumi Kan, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 807 days.

(21) Appl. No.: 10/504,979

(22) PCT Filed: Feb. 24, 2003

(86) PCT No.: PCT/JP03/01991

§ 371 (c)(1),
(2), (4) Date: Apr. 6, 2005

(87) PCT Pub. No.: WO03/071570

PCT Pub. Date: Aug. 28, 2003

(65) Prior Publication Data

US 2005/0174052 A1 Aug. 11, 2005

(30) Foreign Application Priority Data

Feb. 22, 2002 (JP) ..... 2002-046862

(51) Int. Cl.
*H01J 40/00* (2006.01)
*H01J 40/16* (2006.01)

(52) U.S. Cl. ..... 313/528; 313/523; 313/103 R

(58) Field of Classification Search ..... 313/528, 313/523, 103 R
See application file for complete search history.

(56) References Cited

U.S. PATENT DOCUMENTS

| | | | | |
|---|---|---|---|---|
| 5,710,435 | A * | 1/1998 | Niigaki et al. | 257/11 |
| 5,982,094 | A * | 11/1999 | Niigaki et al. | 313/542 |
| 5,986,387 | A * | 11/1999 | Niigaki et al. | 313/103 R |
| 6,396,049 | B1 * | 5/2002 | Estrera et al. | 313/528 |
| 7,208,874 | B2 * | 4/2007 | Niigaki et al. | 313/542 |
| 2002/0011787 | A1 * | 1/2002 | Niigaki et al. | 313/527 |
| 2002/0041154 | A1 * | 4/2002 | Tomasetti et al. | 313/527 |

(Continued)

FOREIGN PATENT DOCUMENTS

CN 1177199 3/1998

(Continued)

*Primary Examiner*—Peter Macchiarolo
(74) *Attorney, Agent, or Firm*—Drinker Biddle & Reath LLP

(57) ABSTRACT

A transmission type photocathode includes a light absorption layer 1 formed of diamond or a material containing diamond as a main component, a supporting frame 21 for reinforcing the mechanical strength of the light absorption layer 1, a first electrode 31 provided at the plane of incidence of the light absorption layer 1, and a second electrode 32 provided at the plane of emission of the light absorption layer 1. A voltage is applied between the plane of incidence and plane of emission of the light absorption layer 1 to form an electric field in the light absorption layer 1. When light to be detected is made incident and photoelectrons occur in the light absorption layer 1, the photoelectrons are accelerated to the plane of emission by the electric field formed in the light absorption layer 1, and emitted to the outside of the transmission type photocathode.

12 Claims, 7 Drawing Sheets

U.S. PATENT DOCUMENTS

| | | | | |
|---|---|---|---|---|
| 2004/0094755 | A1* | 5/2004 | Hirohata et al. | 257/10 |
| 2004/0100194 | A1* | 5/2004 | Eden et al. | 313/538 |
| 2005/0104527 | A1* | 5/2005 | Niigaki et al. | 315/168 |
| 2007/0096648 | A1* | 5/2007 | Nakajima et al. | 313/542 |

FOREIGN PATENT DOCUMENTS

| | | |
|---|---|---|
| JP | 9-199075 | 7/1997 |
| JP | 10-49761 | 6/1998 |
| JP | 10-149761 | 6/1998 |
| JP | 10-223131 | 8/1998 |
| JP | 11-233000 | 8/1999 |
| JP | 2000-357449 | 12/2000 |
| JP | 2001-357449 | 12/2000 |
| JP | 2001-006531 | 1/2001 |
| JP | 2001-233694 | 8/2001 |

* cited by examiner

TRANSMISSION TYPE PHOTOCATHODE INCLUDING LIGHT ABSORPTION LAYER AND VOLTAGE APPLYING ARRANGEMENT AND ELECTRON TUBE

FIELD OF THE ART

The present invention relates to a photocathode for absorbing light to be detected to excite photoelectrons and emitting the photoelectrons thus excited to the outside, and an electron tube having the photocathode.

BACKGROUND ART

There have been hitherto known a photocathode used to detect light to be detected having a prescribed wavelength, and an electron tube having the photocathode. The photocathode has a light absorption layer for absorbing light having a prescribed wavelength and emitting photoelectrons. Light to be detected is made incident to the light absorption layer, and the incident light to be detected is converted to photoelectrons, whereby the light to be detected can be detected. Various kinds of semiconductor materials are used for the light absorption layer, and polycrystalline diamond has been disclosed as a material having a high quantum efficiency for photoelectrical conversion of ultraviolet light in Japanese Unexamined Patent Application Publication (Tokukai) No. H10-149761.

In connection with recent high semiconductor integration design, miniaturization of semiconductor integrated circuits has been rapidly promoted. At present, photolithography is greatly expected as a method of manufacturing minute semiconductor integrated circuits, and research into light sources is advancing from an ArF excimer laser to lasers having shorter wavelengths such as an $F_2$ laser, etc. In connection with developments of techniques using light having shorter wavelengths such as ultraviolet light, etc., photodetectors for monitoring ultraviolet light have been required.

DISCLOSURE OF THE INVENTION

Internal photoelectric effect elements such as an Si photodiode, etc., which have been hitherto used as photodetectors for ultraviolet light, etc., have a problem that p/n junction or Schottky junction thereof is deteriorated by incidence of strong ultraviolet light and they do not operate stably.

On the other hand, external photoelectric effect elements such as an electron tube using a photocathode, etc., generally have no deterioration problem described above because they have neither p/n junction nor Schottky electrode. There are two types of photocathodes, one of which is a reflection type and a transmission type. In the reflection type, a plane of incidence to which light to be detected is made incident and a plane of emission from which photoelectrons are emitted are the same face, and in the transmission type, the plane of incidence and the plane of emission are different faces.

From experiments made by the inventor of this application, it has been found that the surface state of a reflection type photocathode formed of diamond is varied by incidence of strong ultraviolet light, and thus it has been observed that the emission efficiency of photoelectrons is reduced by variation of a work function.

On the other hand, in the case of a transmission type photocathode formed of diamond, photoelectrons caused by incidence of light to be detected must be emitted from the plane of emission at the opposite side, and thus a thin diamond film is needed. From inventor's experiments concerning emission of photoelectrons of diamond film, it has been found that the diffusion length of photoelectrons in diamond film is equal to about 0.05 μm. Furthermore, in order to efficiently emit photoelectrons, it is required to set the film thickness of the diamond film to the same level as the diffusion length. However, in actuality, it is difficult to form diamond film having such a small thickness on a substrate transparent to ultraviolet light, for example, $MgF_2$, sapphire, quartz substrate, and thus it has been difficult to realize a transmission type photocathode formed of diamond. Therefore, a transmission type photocathode having sufficient sensitivity to light having a short wavelength such as ultraviolet light or the like has not been realized.

The present invention has been realized to solve the above problem, and has an object to provide a transmission type photocathode which has sufficient sensitivity to light having a short wavelength such as ultraviolet light or the like, and also allows photoelectrons occurring through photoelectric conversion to be emitted with high efficiency, and also provides an electron tube using the photocathode.

In order to attain the above object, a transmission type photocathode according to the present invention from which photoelectrons excited by incident light to be detected are emitted, is characterized by comprising a light absorption layer which is formed of diamond or material containing diamond as a main component and has one face corresponding to a plane of incidence to which the light to be detected is made incident and the other face corresponding to a plane of emission from which the photoelectrons are emitted, and voltage applying means for applying a predetermined voltage between the plane of incidence and plane of emission of the light absorption layer.

The transmission type photocathode is designed so that one face thereof serves as the plane of incidence and the other face thereof serves as the plane of emission, whereby reduction of the emission efficiency of the photoelectrons can be prevented without variation of the surface state of the plane of emission due to incidence of strong ultraviolet light. Furthermore, the light absorption layer is formed of diamond or material containing diamond as a main component, whereby the efficiency of converting light to be detected having a short wavelength such as ultraviolet light or the like to photoelectrons can be improved. Furthermore, the voltage applying means forms an electric field in the light absorption layer, so that the photoelectrons easily reach the plane of emission and can be emitted with high efficiency.

The transmission type photocathode is preferably provided with supporting means for reinforcing the mechanical strength of the light absorption layer. Accordingly, the mechanical strength of the light absorption layer which is thinly formed can be reinforced.

Furthermore, the light absorption layer is preferably formed of polycrystalline diamond or material containing polycrystalline diamond as a main component. The polycrystalline diamond can more efficiently emit photoelectrons than monocrystalline diamond because it has a grain boundary plane in the thin film thereof. Furthermore, polycrystalline diamond is more easily formed than monocrystalline diamond, and thus it can be manufactured at low cost.

Furthermore, when the light absorption layer is formed of polycrystalline diamond, it is preferable that the grain boundary planes are terminated with oxygen. With this construction, these grain boundary planes are stable, and thus the electrical characteristic can be maintained over a long time.

Furthermore, it is preferable that the plane of emission of the light absorption layer is terminated with oxygen. With this construction, the plane of emission is stable, and the electrical characteristic can be maintained over a long time. Alternatively, it is preferable that the plane of emission of the light absorption layer is terminated with hydrogen. With this construction, the work function of the plane of emission can be reduced, and photoelectrons reaching the plane of emission can be easily emitted to the outside of the transmission type photocathode.

Furthermore, it is preferable that an active layer for reducing the work function of the light absorption is formed on the plane of emission of the light absorption layer. With this construction, photoelectrons reaching the plane of emission of the light absorption layer can be more easily emitted to the outside of the transmission type photocathode. The above effect can be further improved when the active layer is formed of alkali metal, oxide of alkali metal or fluoride of alkali metal.

An electron tube according to the present invention is preferably provided with the transmission type photocathode described above, an anode for directly or indirectly collecting photoelectrons emitted from the transmission type photocathode, and an envelope for accommodating the transmission type photocathode and the anode therein. According to the electron tube using the transmission type photocathode as described above, light to be detected having a short wavelength such as ultraviolet light or the like can be detected with high quantum efficiency.

The electron tube may be provided with electron multiplying means for subjecting the photoelectrons emitted from the transmission type photocathode to secondary electron multiplication. A photoelectron multiplier which can detect weak light to be detected as large signal current can be achieved by using the electron tube as described above. Accordingly, ultraviolet light or the like can be detected with high S/N ratio and high precision.

Furthermore, it is preferable that the anode is formed of fluorescent material which emits light upon incidence of electrons thereto. An image tube that, an image of light to be detected can be reproduced with high precision by using the electron tube as described above, can be obtained.

Still furthermore, the electron tube may be provided with a fluorescent material for emitting light upon incidence of electrons thereto, and the fluorescent material located at the position corresponding to an incident position of light to be detected to the transmission type photocathode is made to emit light, so that an image is displayed. By using the electron tube as an image display device as described above, a still image or moving picture can be displayed with lower power consumption and higher brightness than the prior art by making an optical signal having position information made incident to the electron tube.

BEST MODE FOR CARRYING OUT THE INVENTION

Figure 1:
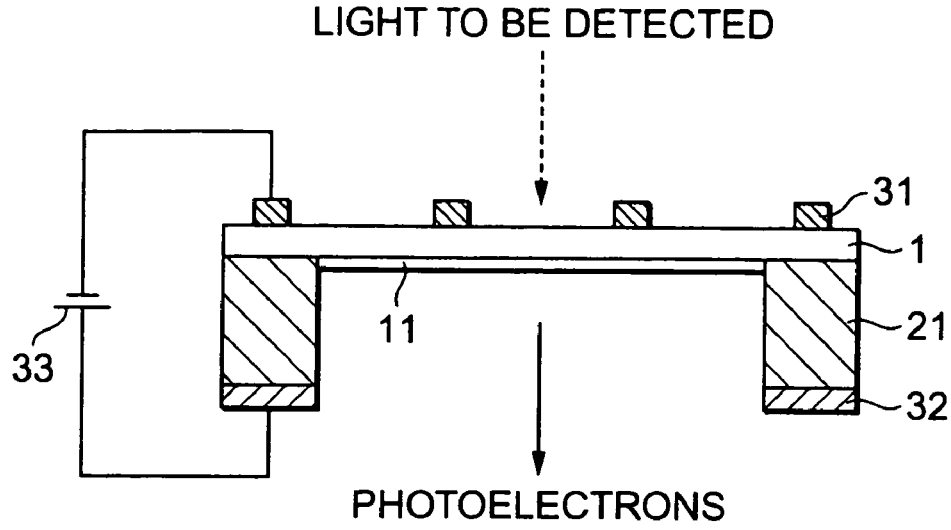
FIG. 1 is a cross-sectional view showing the construction of a first embodiment of a transmission type photocathode according to the present invention.

Preferred embodiments of a transmission type photocathode and electron tube according to the present invention will be described in detail with reference to the accompanying drawings. In the description of the drawings, the same elements are represented by reference numerals, and overlapping description is omitted. The dimensional ratio of the drawings does not necessarily correspond with that of the description.

Figure 2:
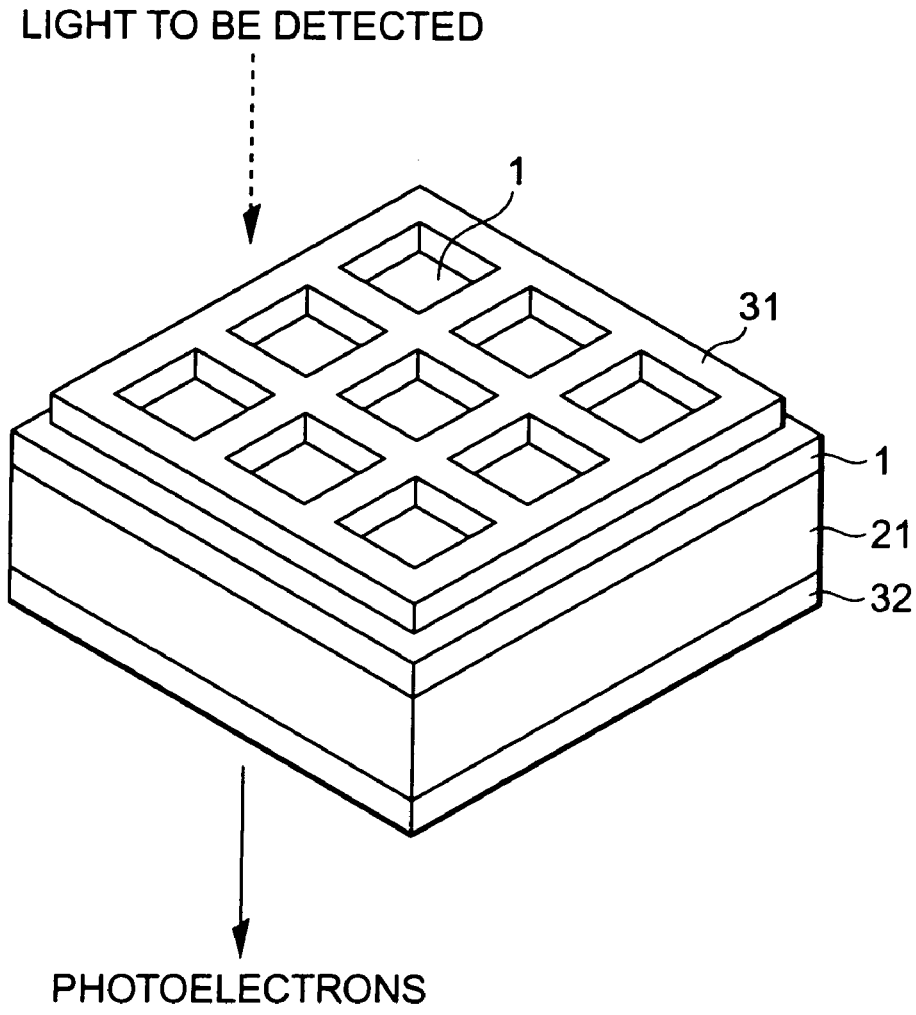
FIG. 2 is a perspective view showing the transmission type photocathode shown in FIG. 1.

FIG. 1 is a side and cross-sectional view showing the construction of a first embodiment of a transmission type photocathode of the present invention. FIG. 2 is a perspective view showing the transmission type photocathode shown in FIG. 1.

The transmission type photocathode shown in FIG. 1 comprises a light absorption layer 1, a supporting frame 21, a first electrode 31 and a second electrode 32. In the transmission type photocathode, photoelectrons are excited in the light absorption layer 1 upon incidence of light to be detected such as ultraviolet light or the like, and the photoelectrons thus excited are emitted to the outside. The transmission type photocathode has a transmission type structure that one surface of the light absorption layer 1 (the upper surface of FIG. 1) serves as a plane of incidence to which the light to be detected is made incident and the other surface at the opposite side of the light absorption layer 1 (the lower surface of FIG. 1) serves as a plane of emission from which photoelectrons are emitted.

The light absorption layer 1 comprises diamond film formed of diamond or a material containing diamond as a main component. The light absorption layer 1 is preferably designed to be sufficiently larger in thickness than the incident depth of the light to be detected. Furthermore, it is preferable that the plane of emission of the light absorption layer 1 is preferably terminated with oxygen or hydrogen.

The supporting frame 21 serves as supporting means for reinforcing the mechanical strength of the light absorption layer 1 which is formed to be thin. The supporting frame 21 is formed of material such as Si, and it is provided at the outer edge part on the plane of emission of the light absorption layer 1.

The first electrode 31 is an incident plane side electrode provided at the plane of incidence of the light absorption layer 1. In this embodiment, the first electrode 31 is formed in a latticed shape on the plane of incidence of the light absorption layer 1 as shown in FIG. 2. The second electrode 32 is an emission plane side electrode provided at the plane of emission of the light absorption layer 1. In this embodiment, the second electrode 32 is formed on the overall surface at the opposite side of the supporting frame 21 at the light absorption layer 1 side. The first electrode 31 and the second electrode 32 are provided as voltage applying means for applying a voltage between the plane of incidence and plane of emission of the light absorption layer 1 to form an electric field in the light absorption layer 1.

Furthermore, an active layer 11 for lowering the work function of the plane of emission is formed on the plane of emission of the light absorption layer 1.

When light to be detected is made incident from the plane of incidence of the light absorption layer 1 in the construction of the transmission type photocathode, photoelectrons whose number corresponds to the light amount of the light to be detected occur in the light absorption layer 1. Furthermore, a predetermined voltage is applied by a power source 33 connected between the first electrode 31 and the second electrode 32 to form electric field in the light absorption layer 1 so that the emission plane side is positive and the incident plane side is negative. Under the electric field thus formed, the photoelectrons occurring in the light absorption layer 1 are accelerated in the direction of the emission plane side. After the photoelectrons reach the plane of emission, they are passed through the active layer 11 and emitted to the outside of the transmission type photocathode.

The transmission type photocathode of this embodiment can achieve the following effects. The quantum efficiency is defined as an efficiency at which photoelectrons converted from incident light to be detected in the light absorption layer are emitted from the plane of emission of the transmission type photocathode.

The transmission type photocathode shown in FIG. 1 has the transmission type structure that one surface of the light absorption layer 1 serves as a plane of incidence and the other surface serves as a plane of emission. As described above, the photocathode is designed in the transmission type structure, not in the reflection type structure that the plane of incidence to which the light to be detected is made incident serves as a plane of emission from which photoelectrons are emitted, thereby preventing variation of the surface state of the plane of emission due to incidence of light to be detected such as strong ultraviolet light or the like. Accordingly, the variation of the work function at the plane of emission can be suppressed, and thus the reduction of the emission efficiency of the photoelectrons can be prevented.

The light absorption layer 1 is formed of diamond or a material containing diamond as a main component. Diamond has a higher photoelectric conversion efficiency to ultraviolet light than materials such as CsI, etc., which have been hitherto used as the material of the photocathode. Diamond or material containing diamond as a main component which has such a property is used for the light absorption layer 1, whereby the light absorption layer 1 can convert incident light to be detected having a short wavelength such as ultraviolet light or the like to photoelectrons with high efficiency.

Furthermore, the first electrode 31 is provided at the incident plane side of the light absorption layer 1 and the second electrode 32 is provided at the emission plane side to form electric field in the light absorption layer 1. Accordingly, photoelectrons occurring in the light absorption layer 1 are allowed to efficiently reach the plane of emission, and thus the efficiency of emitting the photoelectrons to the outside of the transmission type photocathode can be improved. Normally, in order to emit the photoelectrons occurring in the light absorption layer 1 to the outside of the light absorption layer 1, it is required to form the thickness of the light absorption layer 1 to the same degree as the diffusion length of photoelectrons. However, it is difficult to form the light absorption layer 1 having such a thickness as diamond film of diamond or material containing diamond as a main component. In the transmission type photocathode of this embodiment, an electric field is formed in the light absorption layer 1 to accelerate photoelectrons occurring in the light absorption layer 1 toward the plane of emission, whereby the photoelectrons can be efficiently emitted even when the thickness of the light absorption layer 1 is equal to several μm, which is larger than the diffusion length.

Here, it is preferable that polycrystalline diamond or material containing polycrystalline diamond as a main component is used as the material of the light absorption layer 1. Polycrystalline diamond is formed of granular crystals, and contains therein grain boundary planes serving as the surfaces of granular crystals. Photoelectrons occurring in the light absorption layer 1 are emitted from the grain boundary planes existing in all the directions in which the photoelectrons are diffused. Therefore, the movement distance at which photoelectrons move from the excitation thereof until the emission thereof is short, and the number of photoelectrons to be emitted is increased. As a result, a higher quantum efficiency can be achieved. Furthermore, as compared with monocrystalline diamond, a larger amount of polycrystalline diamond can be manufactured at lower cost. Therefore, if polycrystalline diamond is used as the material of the light absorption layer 1, the manufacturing cost of the transmission type photocathode could be reduced.

Furthermore, the supporting frame 21 as the supporting means is provided at the outer edge part on the plane of emission of the light absorption layer 1. In order to emit photoelectrons occurring in the light absorption layer 1, the light absorption layer 1 is formed to be thin, and thus it may be insufficient in mechanical strength in some cases. When it is required to reinforce the mechanical strength of the light absorption layer 1, the supporting means such as the supporting frame 21 may be provided at a proper position, for example, at the outer edge part on the plane of emission, whereby the mechanical strength of the light absorption layer 1 can be reinforced.

Furthermore, it is preferable that the plane of emission of the light absorption layer 1 is terminated with oxygen. When the plane of emission of the light absorption layer 1 is terminated with oxygen, the plane of emission of the light absorption layer 1 is stable, and the electrical characteristic can be maintained for a long time. Alternatively, the surface of the plane of emission of the light absorption layer 1 may be terminated with hydrogen. Even when it is terminated with hydrogen, the work function of the plane of emission of the light absorption layer 1 can also be reduced, so that photoelectrons reaching the plane of emission can be easily emitted to the outside of the transmission type photocathode.

Furthermore, when the light absorption layer 1 is formed of polycrystalline diamond or a material containing diamond as a main component, it is preferable that the surface and grain boundary planes of the polycrystalline diamond of the light absorption layer 1 are terminated with oxygen. By terminating these surfaces and planes with oxygen, the plane of emission of the light absorption layer 1 is stable, and the electrical characteristic can be maintained for a long time.

Since the transmission type photocathode shown in FIG. 1 has the transmission type structure, the light to be detected such as ultraviolet light or the like is not made incident to the plane of emission, and the terminated surface state is not varied. Accordingly, the emission efficiency of photoelectrons which is improved by the terminating treatment can be maintained.

Furthermore, it is preferable that the active layer 11 having a property for lowering the work function of diamond is formed on the plane of emission of the light absorption layer 1. By lowering the work function of the plane of emission of the light absorption layer 1, photoelectrons reaching the plane of emission of the light absorption layer can be more easily emitted from the plane of emission of the light absorption layer 1. Furthermore, the active layer is formed of alkali metal, oxide of alkali metal, fluoride of alkali metal or the like to suitably achieve the above effect.

Figure 3:
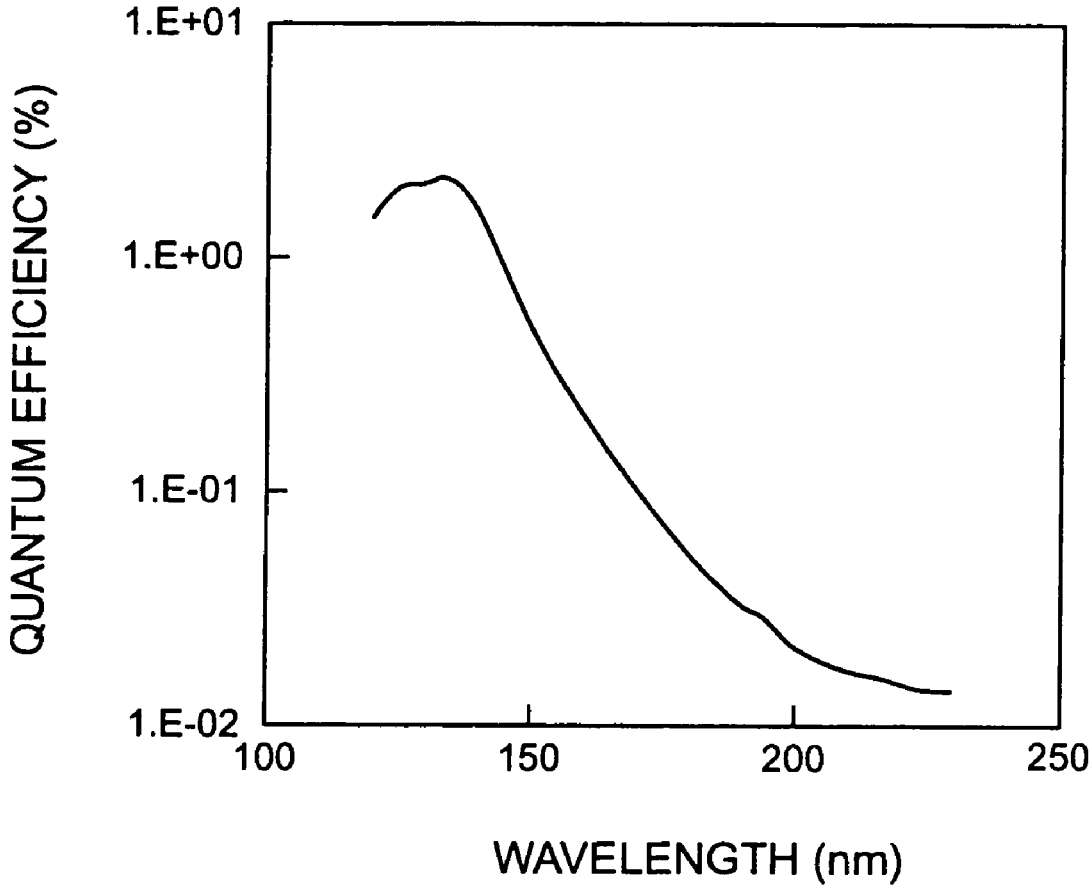
FIG. 3 is a graph showing a spectral sensitivity characteristic showing a quantum efficiency with respect to the wavelength of incident light in the transmission type photocathode shown in FIG. 1.

Here, FIG. 3 shows a graph of a spectral sensitivity characteristic showing the quantum efficiency with respect to the wavelength of incident light. In FIG. 3, the quantum efficiency (%) is represented on the ordinate axis and the wavelength (nm) of the light to be detected is represented on the abscissa axis. By constructing the transmission type photocathode as described above, a high quantum efficiency is realized with respect to light in the vacuum ultraviolet area.

A manufacturing method and a specific construction of the transmission type photocathode shown in FIG. 1 will be described. FIGS. 4A to 4E are step diagrams showing a manufacturing process of the transmission type photocathode shown in FIG. 1.

Figure 4A:
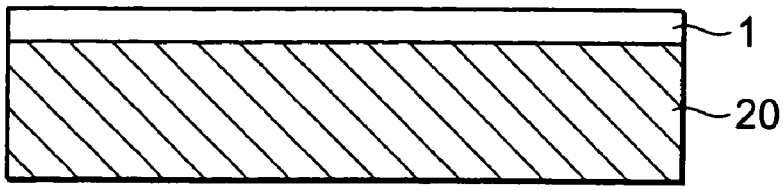
FIGS. 4A to 4E are step diagrams showing a manufacturing process of the transmission type photocathode shown in FIG. 1.

A light absorption layer 1 formed of polycrystalline diamond is deposited at a thickness of about 5 μm on one surface of a substrate 20 of Si (FIG. 4A). Synthesis methods such as a chemical vapor deposition method (CVD method) using a heat filament or a microwave plasma, a laser ablation method or the like may be used as a method for forming a thin layer of polycrystalline diamond. The material of the substrate 20 is not limited to Si, and it may be metal having a high melting point such as molybdenum, tantalum, quartz, sapphire.

Figure 4B:
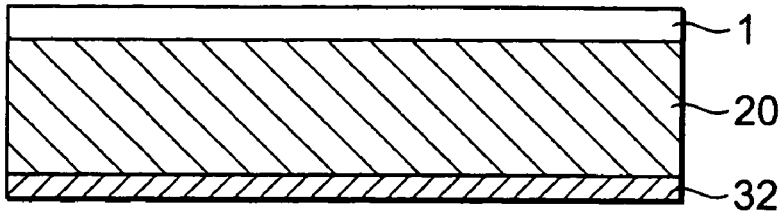
Figure 4C:
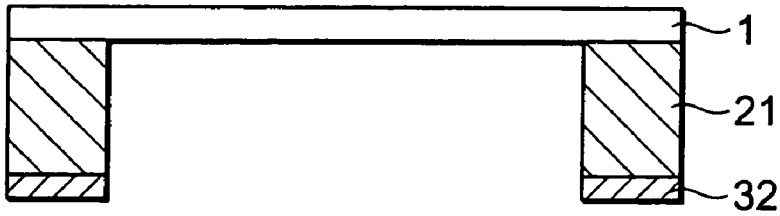

Subsequently, the second electrode 32 is formed on the other surface of the substrate 20 by vapor deposition (FIG. 4B). Then, the second electrode 32 and the substrate 20 are partially removed from the other surface side of the substrate 20 by etching using a mask having a proper dimension to expose a part of the light absorption layer 1 (FIG. 4C). The etching is carried out with $HF+HNO_3$ solution or KOH solution, and when the substrate 20 is etched and the light absorption layer 1 is exposed, the etching is automatically stopped. The non-etched portion of the substrate 20 functions as the supporting frame 21 to reinforce the mechanical strength of the light absorption layer 1.

Figure 4D:
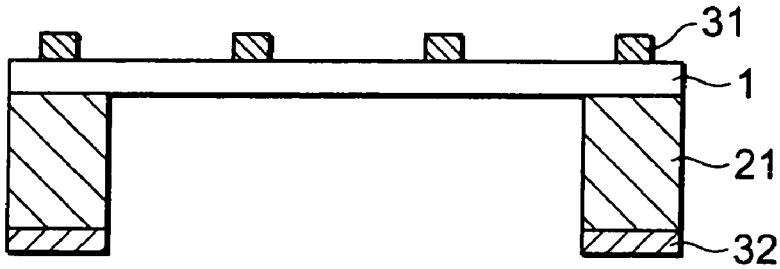

By using a photolithography technique and a lift-off technique, the lattice-shaped first electrode 31 having a proper dimension is formed on the surface (plane of incidence) of the light absorption layer 1 at the opposite side to the surface (plane of emission) of the light absorption layer 1 which is exposed by the etching (FIG. 4D). The plane of emission of the light absorption layer 1 is cleaned while the result is kept under vacuum, and then the plane of emission, etc., are terminated with oxygen or hydrogen.

Figure 4E:
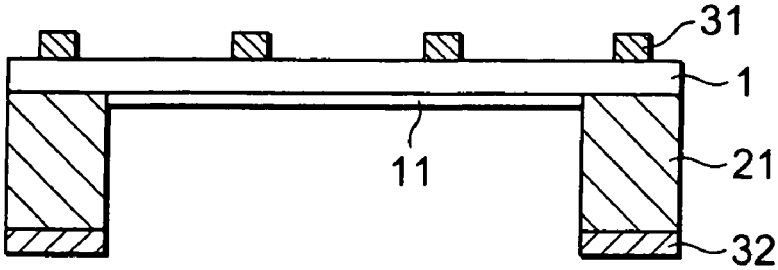

Finally, a material having a property for lowering the work function of the diamond surface, such as alkali metal, oxide of alkali metal, fluoride of alkali metal or the like, is coated on the plane of emission of the light absorption layer 1 to form the active layer 11 (FIG. 4E).

Through the manufacturing process, the transmission type photocathode according to the first embodiment can be manufactured. The manufacturing method and the specific construction of the transmission type photocathode are not limited to the above embodiments, and various methods and constructions may be used.

Figure 5:
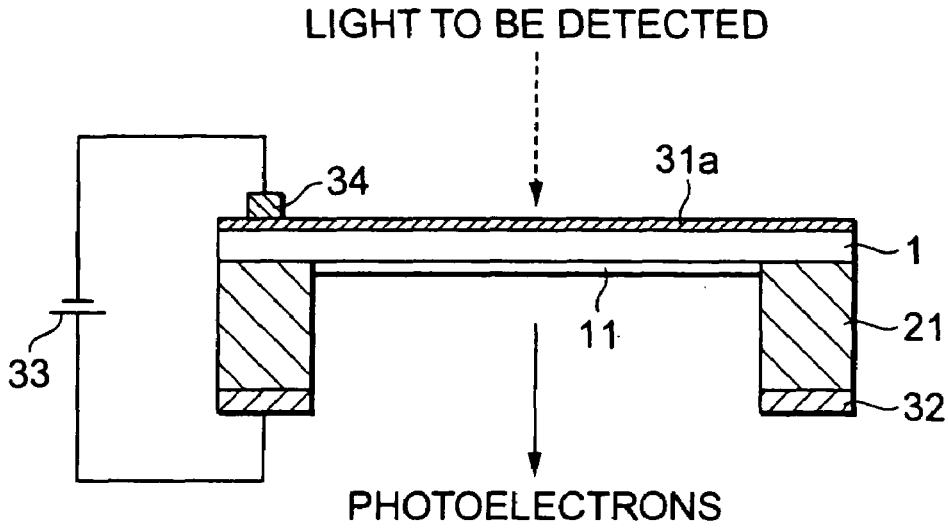
FIG. 5 is a side and cross-sectional view showing the construction of a second embodiment of the transmission type photocathode.

FIG. 5 is a side and cross-sectional view showing the construction of a second embodiment of the transmission type photocathode.

The transmission type photocathode shown in FIG. 5 comprises a light absorption layer 1, an active layer 11, a supporting frame 21, first electrode film 31*a*, an auxiliary electrode 34 and a second electrode 32. The constructions of the light absorption layer 1, the active layer 11, the supporting frame 21 and the second electrode 32 are the same as the transmission type photocathode shown in FIG. 1.

The first electrode film 31*a* is formed in a thin film form on the plane of incidence of the light absorption layer 1. The first electrode film 31*a* is formed to be extremely thin (about 30 to 150□ in thickness). The auxiliary electrode 34 is formed on the first electrode film 31*a* for electrical connection to the first electrode film 31*a* formed in a thin film form.

The transmission type photocathode of this embodiment has the transmission type structure that one surface of the light absorption layer 1 serves as a plane of incidence and the other surface thereof serves as a plane of emission. With this construction, variation of the surface state of the plane of emission can be prevented, and the emission efficiency of photoelectrons can be prevented from being lowered. Furthermore, when the light absorption layer 1 is formed of diamond or a material containing diamond as a main component, the light absorption layer 1 can convert incident light to be detected having a short wavelength such as ultraviolet light or the like to photoelectrons with high efficiency.

Furthermore, the first electrode film 31*a* is provided at the incident plane side of the light absorption layer 1, and the second electrode 32 is provided at the emission plane side to form an electric field in the light absorption layer 1. The electric field is formed in the light absorption layer 1 to accelerate photoelectrons occurring in the light absorption layer 1 to the plane of emission, whereby the photoelectrons can be emitted to the outside of the transmission type photocathode with high efficiency.

Furthermore, the first electrode film 31*a* is formed in a thin film form on the plane of incidence of the light absorption layer 1. The transmission type photocathode can be properly operated by forming the electrode coming into contact with the light absorption layer 1 out of the electrodes constituting the voltage applying means as in the case of the first electrode 31 shown in FIG. 1. However, when it is required that the manufacturing process is further simplified, the electrode concerned may be formed in a thin film form as shown in FIG. 5 by deposition or the like. By forming the electrode as described above, the voltage applying means for improving the quantum efficiency in the transmission type photocathode can be provided with a more simple manufacturing process.

Figure 6:
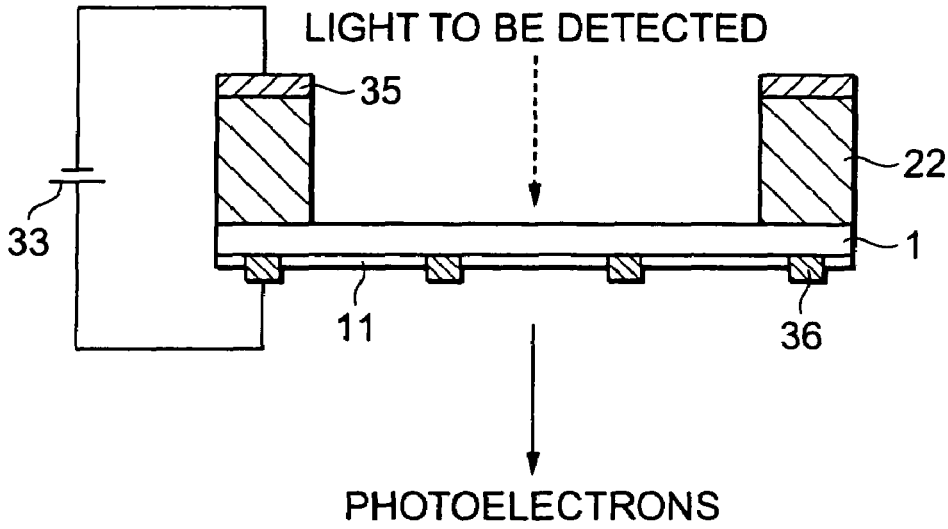
FIG. 6 is a side cross-sectional view showing the construction of a third embodiment of the transmission type photocathode.

FIG. 6 is a side cross-sectional view showing the construction of a third embodiment of the transmission type photocathode.

The transmission type photocathode shown in FIG. 6 comprises a light absorption layer 1, an active layer 11, a supporting frame 22, a first electrode 35 and a second electrode 36. The constructions of the light absorption layer 1 and the active layer 11 out of these elements are the same as the transmission type photocathode shown in FIG. 1.

The supporting frame 22 serves as supporting means for reinforcing the mechanical strength of the light absorption layer 1 which is formed to be thin. The supporting frame 22 is provided at the outer edge part on the plane of incidence of the light absorption layer 1.

The first electrode 35 is an incident plane side electrode provided at the plane of incidence of the light absorption layer 1. In this embodiment, the first electrode 35 is formed on the overall surface of the supporting frame 22 at the opposite side to the light absorption layer 1 side. The second electrode 36 is an emission plane side electrode provided at the plane of emission of the light absorption layer 1. In this embodiment, the second electrode 36 is formed in a latticed shape on the plane of emission of the light absorption layer 1. The first electrode 35 and the second electrode 36 are provided as voltage applying means for applying a voltage between the plane of incidence and plane of emission of the light absorption layer 1 to form an electric field in the light absorption layer 1.

The transmission type photocathode of this embodiment has the transmission type structure that one surface of the light absorption layer 1 serves as a plane of incidence and the other surface thereof serves as a plane of emission. With this construction, variation of the surface state of the plane of emission can be prevented, and reduction in emission efficiency of photoelectrons can be prevented. When the light absorption layer 1 is formed of diamond or a material containing diamond as a main component, the light absorption layer 1 can convert incident light to be detected having a short wavelength such as ultraviolet light or the like to photoelectrons with high efficiency.

Furthermore, the first electrode 35 is provided at the incident plane side of the light absorption layer 1 and the second electrode 36 is provided at the emission plane side to form electric field in the light absorption layer 1. The electric field is formed in the light absorption layer 1 to accelerate photoelectrons occurring in the light absorption layer 1 to the plane of emission, whereby the photoelectrons can be emitted to the outside of the transmission type photocathode with high efficiency.

The supporting frame 22 serving as supporting means is provided at the outer edge part on the plane of incidence of the light absorption layer 1. When it is required to reinforce the mechanical strength of the light absorption layer 1 which is formed to be thin, the supporting means may be provided at the plane of emission as shown in FIG. 1, or may be provided at the plane of incidence as in the case of this embodiment, whereby the mechanical strength of the light absorption layer 1 can be properly reinforced.

Figure 7A:
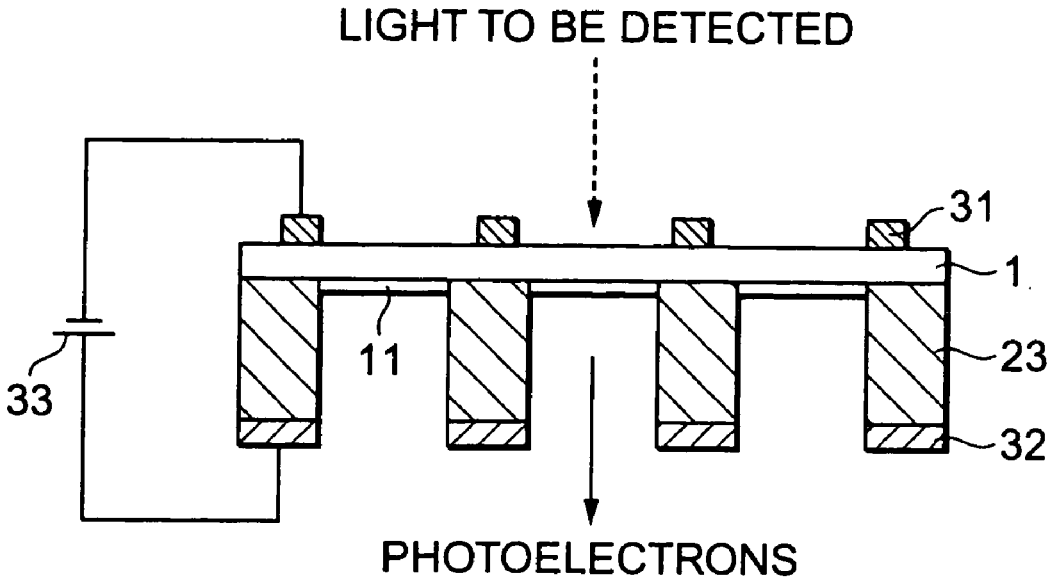
FIG. 7A is a side cross-sectional view showing the construction of a fourth embodiment of the transmission type photocathode.
Figure 7B:
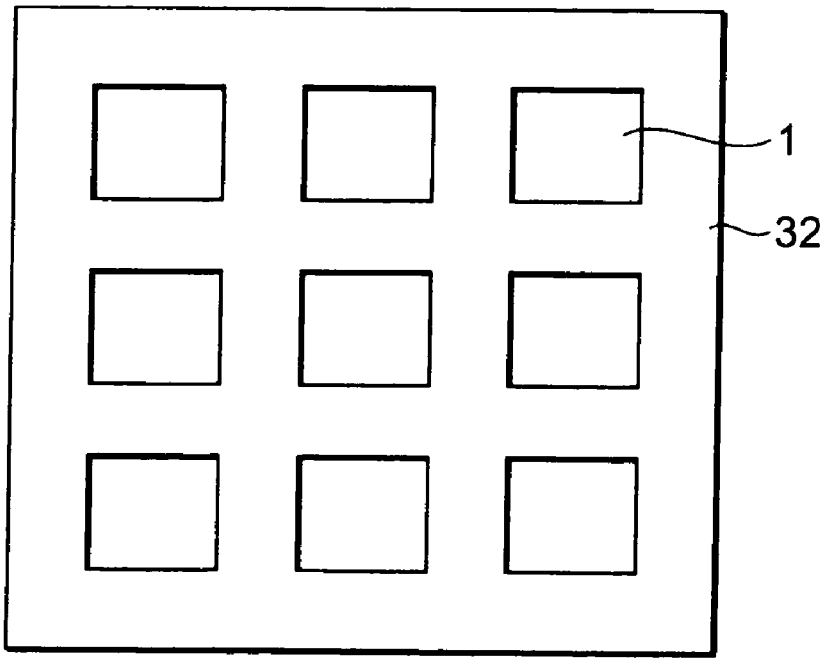
FIG. 7B is a bottom view of the fourth embodiment.

FIGS. 7A and 7B are diagrams showing the construction of a fourth embodiment of the transmission type photocathode. FIG. 7A is a side cross-sectional view of the transmission type photocathode, and FIG. 7B is a bottom view of the transmission type photocathode which is taken from the second electrode 32 side.

The transmission type photocathode shown in FIG. 7A comprises a light absorption layer 1, an active layer 11, a supporting frame 23, a first electrode 31 and a second electrode 32. The constructions of the light absorption layer 1, the active layer 11 and the first electrode 31 out of the above elements are the same as the transmission type photocathode shown in FIG. 1.

The supporting frame 23 is provided in the latticed shape as shown in FIG. 7B on the plane of emission of the light absorption layer 1. The supporting frame 23 is formed so that the respective lattice-shaped frames of the supporting frame 23 are uniform in shape and area. The second electrode 32 is formed on the overall surface of the lattice-shaped supporting frame 23 at the opposite side of the light absorption layer 1 side.

The transmission type photocathode of this embodiment has the transmission type structure that one surface of the light absorption layer 1 serves as a plane of incidence and the other surface thereof serves as a plane of emission. With this construction, the variation of the surface state of the plane of emission can be prevented, and the reduction in emission efficiency of photoelectrons can be prevented. Furthermore, when the light absorption layer 1 is formed of diamond or a material containing diamond as a main component, the light absorption layer 1 can convert incident light to be detected having a short wavelength such as ultraviolet light or the like to photoelectrons with high efficiency.

The first electrode 31 is provided at the incident plane side and the second electrode 32 is provided at the emission plane side to form an electric field in the light absorption layer 1. By forming the electric field in the light absorption layer 1, photoelectrons occurring in the light absorption layer 1 are accelerated to the plane of emission, whereby the photoelectrons can be efficiently emitted to the outside of the transmission type photocathode.

Furthermore, the supporting frame 23 for reinforcing the mechanical strength of the light absorption layer 1 is provided in a latticed shape. When the light absorption layer 1 has a relatively small area, the strength can be sufficiently reinforced by the supporting means having the shape as shown in FIG. 1. However, when it is required to further compensate for mechanical strength because the area of the light absorption layer 1 is large or the like, the mechanical strength of the light absorption layer 1 can be further reinforced by providing the supporting means having the shape like this embodiment. At this time, if the supporting frame 23 is provided so that the shape and area in each of the respective lattice-shaped frames are uniform, the mechanical strength can be further improved. The shape of the supporting means is not limited to the latticed shape, and various shapes may be adopted.

In the third and fourth embodiments of the transmission type photocathode, the second electrode 36 and the first electrode 31 are formed in a latticed shape, however, they may be designed in a thin film form as in the case of the first electrode film 31*a* of the second embodiment. A latticed shape, a thin film shape or other shapes may be properly selected as the shape of the electrode formed on the surface of the light absorption layer 1.

The transmission type photocathode described above may be applied to an electron tube such as a photoelectron multiplier, an image intensifier or the like. Preferred embodiments of the electron tube will be described hereunder. Here, illustrations of the voltage applying means, etc., provided at the transmission type photocathode are omitted.

Figure 8:
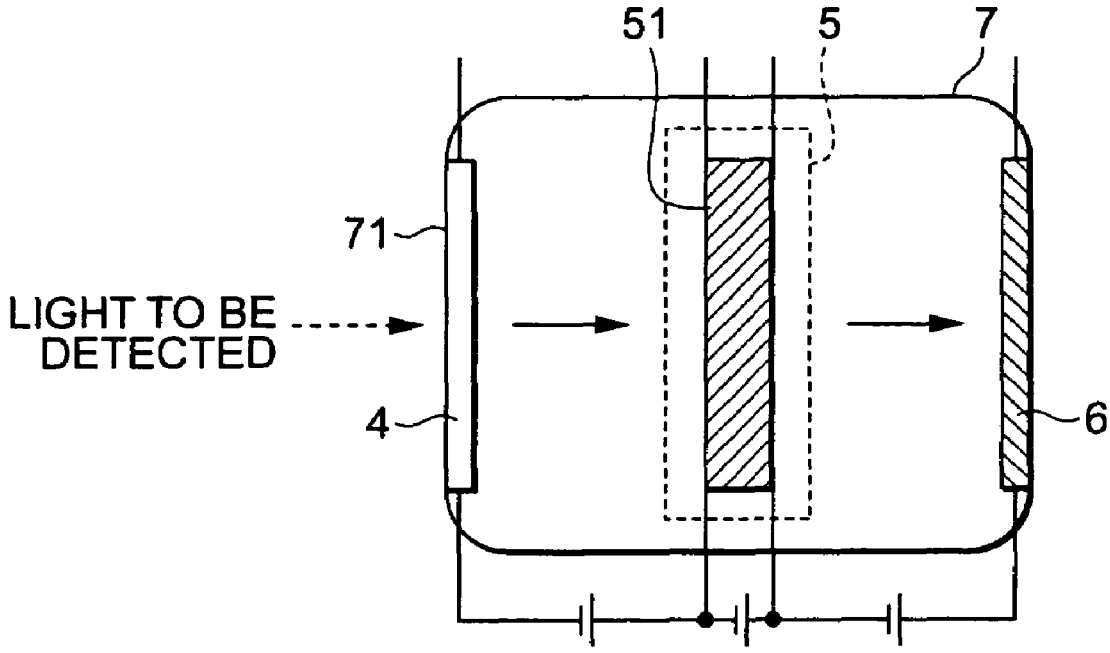
FIG. 8 is a cross-sectional view showing the construction of a first embodiment of a photoelectron multiplier as a first embodiment of an electron tube of the present invention.

FIG. 8 is a cross-sectional view showing the construction of an embodiment of a photoelectron multiplier as a first embodiment of the electron tube according to the present invention.

The photoelectron multiplier shown in FIG. 8 comprises a transmission type photocathode 4 for converting light to be detected to photoelectrons and emitting the photoelectrons thus converted, electron multiplying means 5 for subjecting the photoelectrons to secondary electron multiplication, an anode 6 for collecting multiplied secondary electrons, and a vacuum envelope 7 in which the above constituent elements are accommodated under a vacuum state. These constituent elements are arranged at predetermined intervals from the incident side of the light to be detected in the following order: the transmission type photocathode 4, the electron multiplying means 5 and the anode 6.

The transmission type photocathode formed of diamond or a material containing diamond as a main component as described above is used as the transmission type photocathode 4. The electron multiplying means 5 is provided at the emission plane side of the transmission type photocathode 4 so as to be spaced from the emission plane side at a predetermined distance. A micro channel plate (hereinafter referred to as "MCP") 51 is used as the electron multiplying means 5. MCP 51 is designed to have many cylindrical channels which are bundled into one body and whose inner walls serve as a secondary electrons emitter. A predetermined voltage is applied between an input end of each channel to which photoelectrons are made incident and an output end of the channel from which secondary electrons are emitted, thereby forming an electric field between the input and output ends of each channel. A photoelectron made incident to each channel is multiplied while repetitively impinging against the secondary electron emitter, and emitted as secondary electrons.

The anode 6 is provided so as to be spaced from the output end of MCP 51 at a predetermined distance. The anode 6 collects the secondary electrons emitted from MCP 51 to indirectly collect photoelectrons emitted from the transmission type photocathode 4.

The transmission type photocathode 4, the electron multiplying means 5 and the anode 6 are enveloped in a vacuum envelope 7 serving as a hermetically-sealed envelope whose inside is kept under a vacuum state. An entrance window 71 is provided in a surface of the vacuum envelope 7 which faces the transmission type photocathode 4 to which light to be detected serves as made incident. Accordingly, the light to be detected having a predetermined wavelength out of incident light can be made incident to the transmission type photocathode 4 with high efficiency. A stepwise voltage is applied to the transmission type photocathode 4, the input end and output end of MCP 51 and the anode 6 so that the transmission type photocathode 4 side is set to a negative potential and the anode 6 side is set to a positive potential to thereby form an electric field.

In the above construction, when the light to be detected is made incident through the entrance window 71 to the plane of incidence of the transmission type photocathode 4, photoelectrons are generated in the transmission type photocathode 4, and emitted from the plane of emission to vacuum in the vacuum envelope 7. A positive voltage with respect to the transmission type photocathode 4 is applied to the input end of MCP 51 to form an electric field, and the photoelectrons emitted into vacuum are made incident to MCP 51. The photoelectrons are multiplied into secondary electrons in the channels of MCP 51, and the secondary electrons thus generated are emitted into the vacuum again. At this time, the secondary electrons passed through MCP 51 are multiplied by about one hundred million times of the photoelectrons, for example. A positive voltage with respect to the output end of MCP 51 is applied to the anode 6 to form an electric field, and the secondary electrons emitted from MCP 51 are collected by the anode and taken out to the outside of the photoelectron multiplier as a detection signal caused by the light to be detected.

The following effect can be achieved by the above construction and operation of the photoelectron multiplier shown in FIG. 8. That is, a photoelectron multiplier which can detect light to be detected such as ultraviolet light or the like with a high quantum efficiency can be realized by using the transmission type photocathode 4 having the above construction.

Furthermore, when light to be detected is weak, a detection signal of multiplied and large current can be achieved by using the electron multiplying means as shown in FIG. 8, so that the light to be detected can be detected with high S/N ratio and high efficiency.

Figure 9:
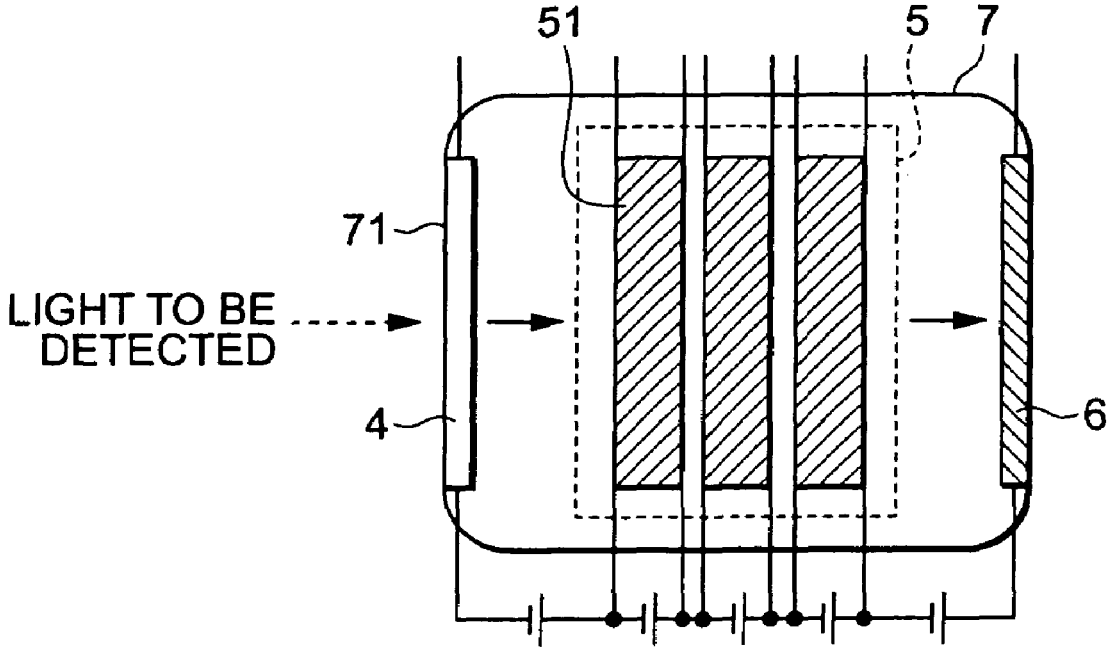
FIG. 9 is a cross-sectional view schematically showing the construction of another embodiment of the photoelectron multiplier tube as a second embodiment of the electron tube.

FIG. 9 is a cross-sectional view showing the construction of another embodiment of the photoelectron multiplier as a second embodiment of the electron tube.

The photoelectron multiplier shown in FIG. 9 comprises a transmission type photocathode 4, electron multiplying means 5, an anode 6 and a vacuum envelope 7. The constructions of the transmission type photocathode 4, the anode 6 and the vacuum envelope 7 are the same as the photoelectron multiplier shown in FIG. 8.

Plural MCP 51 (three in FIG. 9) are used as the electron multiplying means 5. Each of the plural MCPs 51 has many cylindrical channels which are bundled and whose inner walls serve as secondary electron emitters, and a predetermined voltage is applied between the input and output ends of each channel to form an electric field. The plural MCPs 51 are arranged at a predetermined interval so that each output end and each input end face each other. The anode 6 is provided so as to be spaced at a predetermined distance from the output terminal of MCP 51 located at the farthest position from the transmission type photocathode 4. The anode 6 collects secondary electrons emitted from the MCP 51 concerned.

In this construction, when light to be detected is made incident through the entrance window 71 to the plane of incidence of the transmission type photocathode 4, photoelectrons are generated in the transmission type photocathode 4 and emitted from the plane of emission to vacuum in the vacuum envelope 7. The photoelectrons emitted into the vacuum are made incident as primary electrons to MCP 51 located at the nearest position to the transmission type photocathode 4, multiplied and emitted as secondary electrons. These electrons are repetitively multiplied by the plural MCPs 51 arranged after the nearest MCP 51 concerned. Finally, the secondary electrons thus multiplied are collected by the anode 6, and taken out as a detection signal based on the incident light to be detected to the outside of the photoelectron multiplier.

The following effect can be achieved by the above construction and operation of the photoelectron multiplier shown in FIG. 9. That is, a photoelectron multiplier which can detect light to be detected such as ultraviolet light or the like with a high quantum efficiency can be realized by using the transmission type photocathode 4 having the above construction.

By using plural MCPs 51 as the electron multiplying means 5, a large detection signal can be achieved with a high secondary electron multiplication rate, so that the light to be detected can be detected with a higher S/N ratio and higher efficiency.

Each of the embodiments of the photoelectron multiplier has a so-called proximate type in which the transmission type photocathode 4, MCP 51 and the anode 6 are opposed to one another, however, there may be adopted a so-called electrostatic focusing mode construction in which an electrostatic lens is provided between the transmission type photocathode 4 and the electron multiplying means 5 to focus photoelectrons. In addition to the construction of the photoelectron multiplier described above may be used another construction where no electron multiplying means 5 is provided, that is, photoelectrons emitted from the transmission type photocathode 4 are directly collected by the anode 6.

The anode 6 for collecting photoelectrons or secondary electrons is provided. However, a semiconductor element such as a photodiode or the like may be provided in place of the anode 6. Each of the above-described embodiments of the photoelectron multiplier can be suitably executed by operating the photoelectron multiplier as a so-called electric driving mode photoelectron multiplier in which photoelectrons or secondary electrons are directly driven to the semiconductor element as described above.

Figure 10:
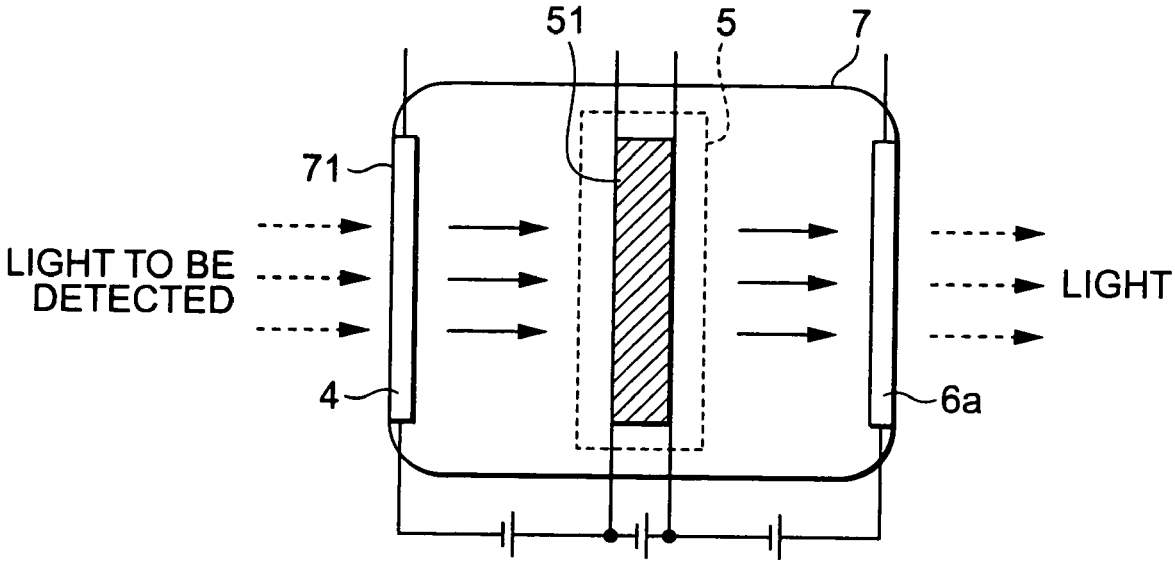
FIG. 10 is a cross-sectional view schematically showing the construction of an image improving tube (image intensifier) as a third embodiment of the electron tube.

FIG. 10 is a cross-sectional view schematically showing the construction of an image intensifier serving as an image tube as a third embodiment of the electron tube.

The image intensifier shown in FIG. 10 comprises a transmission type photocathode 4, electron multiplying means 5, an anode 6*a* and vacuum envelope 7. The constructions of the transmission type photocathode 4, the electron multiplying means 5 and the vacuum envelope 7 are the same as the photoelectron multiplier shown in FIG. 8.

The anode 6*a* has a function of collecting secondary electrons emitted from MCP 51, and is provided so as to be spaced from the output end of MCP 51 at a predetermined distance. The anode 6*a* is formed of fluorescent material which emits light upon incidence of electrons thereto.

In the above construction, when light to be detected constituting an image is made incident through the entrance window 71 to the transmission type photocathode 4, photoelectrons are generated in the transmission type photocathode 4 and emitted into the vacuum envelope 7. The photoelectrons thus emitted are made incident to MCP 51. At this time, a positive voltage with respect to the transmission type photocathode 4 is applied to the input end of MCP 51 to form an electric field. Photoelectrons travel in parallel to the electric field, and thus the photoelectrons are made incident to MCP 51 while keeping two-dimensional information when the light to be detected is made incident to the image intensifier. The photoelectrons made incident to MCP 51 are multiplied and emitted as secondary electrons, and then collected by the anode 6*a* formed of fluorescent material. At this time, a positive voltage with respect to the input terminal is applied to the output end of MCP 51, and a positive voltage with respect to the output terminal of MCP 51 is applied to the anode 6*a*. An electric field is formed by these voltages, and secondary electrons are collected by the anode 6*a* while keeping the two-dimensional information possessed by the photoelectrons, whereby the anode 6*a* formed of fluorescent material emits light. Through the above operation, the image based on the light to be detected made incident to the image intensifier is intensified, and output from the anode 6*a* formed of fluorescent material.

The following effect is achieved by the construction and operation of the image intensifier shown in FIG. 10. That is, an image intensifier having a high quantum efficiency can be realized by using the transmission type photocathode 4 having the above construction.

Furthermore, photoelectrons which are achieved with a high quantum efficiency in accordance with the light amount of light to be detected made incident to the transmission type photocathode 4 are further multiplied and made incident to the fluorescent material, so that a high-brightness image can be achieved. Accordingly, even when an incident image is weak, the image can be intensified with high precision.

In the above-described image intensifier, fluorescent material is used as means for emitting light with photoelectrons or secondary electrons, however, any means may be used insofar as it can convert electrons to an image. For example, the same effect can be achieved by providing an image pickup element such as a charge-coupled device (CCD) or the like in place of the fluorescent material and directly bombarding photoelectrons or secondary electrons into the image pickup element to form an image.

Figure 11:
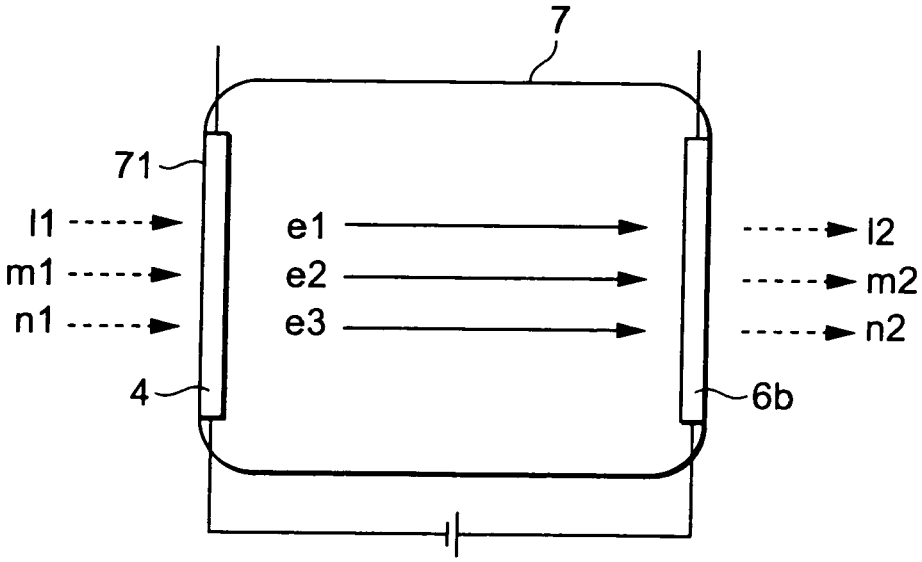
FIG. 11 is a cross-sectional view schematically showing a fourth embodiment of the electron tube.

FIG. 11 is a cross-sectional view schematically showing the construction of a fourth embodiment of the electron tube.

The electron tube shown in FIG. 11 comprises a transmission type photocathode 4, an anode 6*b* and a vacuum envelope 7. The constructions of the transmission type photocathode 4, the anode 6*b* and the vacuum envelope 7 are the same as the image intensifier shown in FIG. 10, however, the electron tube of this embodiment has no electron multiplying means. The electron tube of this embodiment can be used as an image display device for displaying an image by causing light emission from a fluorescent material located at the position corresponding to an incident position of light to be detected made incident to the transmission type photocathode. The operation of the electron tube as an image display device will be described hereunder.

When light to be detected (l1, m1, n1) as an image signal is passed through the entrance window 71 and made incident to a predetermined position of the transmission type photocathode 4, photoelectrons (e1, e2, e3) corresponding to the incident position of the light to be detected are generated in the transmission type photocathode 4 and emitted into the vacuum envelope 7. The photoelectrons emitted into the vacuum are accelerated and travels straightly because a high voltage is applied between the transmission type photocathode 4 and the anode 6*b*, and then they are collected by the anode 6 formed of fluorescent material. That is, lights l2, m2, n2 are emitted from the fluorescent material at the positions corresponding to the lights to be detected l1, m1, n1 which are different in incident position.

In the electron tube shown in FIG. 11, the following effect can be achieved by the construction and the operation described above. That is, an electron tube having a high quantum efficiency can be realized by using the transmission type photocathode 4 having the above construction. Accordingly, a high-brightness image can be achieved from photoelectrons which are achieved with a high quantum efficiency in accordance with the light amount of the image signal input to the transmission type photocathode 4, so that a still picture or moving picture can be displayed with high brightness and low power consumption. Furthermore, when ultraviolet light such as plasma light or the like to which two-dimensional position information such as XY addresses is given is used as an image signal input to the electron tube, an image display device having higher brightness and lower power consumption can be realized as compared with a conventional plasma display in which fluorescent material is directly made to emit light by plasma.

When a higher brightness image is required to be achieved in the image intensifier of the third embodiment and the image display device of the fourth embodiment, any number of MCPs 51 are provided at further increase the secondary electron multiplication rate, whereby an incident image can be further intensified and the brightness thereof can be improved.

The transmission type photocathode and the electron tube of this invention are not limited to the above embodiments, and various modifications may be made. For example, when the mechanical strength of the light absorption layer 1 is sufficient in the respective embodiments of the transmission type photocathode, the transmission type photocathode may be constructed so as to have no supporting frames 21 to 23 for reinforcing the mechanical strength. Furthermore, when photoelectrons can be emitted from the light absorption layer 1 efficiently, it may be constructed so as to have no active layer 11 for lowering the work function of the plane of emission of the light absorption layer 1.

When the strength of the vacuum envelope 7 is insufficient with respect to ambient pressure in each of the embodiments of the electron tube, improving means such as a spacer or the like may be provided in the vacuum envelope 7. Furthermore, MCP 51 is used as the electron multiplying means. However, the electron multiplying means is not limited to MCP, and a one-stage dynode or plural stages of dynode may be used.

INDUSTRIAL APPLICABILITY

The present invention is applicable to an optical monitor device when photolithography is used in a process of manufacturing a semiconductor integrated element, for example.

What is claimed is:

1. A transmission type photocathode for emitting photoelectrons excited by incident light to be detected, comprising:

a light absorption layer formed of diamond or a material containing diamond as a main component, one surface thereof corresponding to a plane of incidence to which the light to be detected is made incident and the other surface thereof corresponding to a plane of emission from which the photoelectrons are emitted; and voltage applying means for applying a predetermined voltage between the plane of incidence and plane of emission of the light absorption layer.

2. The transmission type photocathode according to claim 1, further comprising supporting means for reinforcing mechanical strength of the light absorption layer.

3. The transmission type photocathode according to claim 1, wherein the light absorption layer is formed of polycrystalline diamond or a material containing polycrystalline diamond as a main component.

4. The transmission type photocathode according to claim 3, wherein grain boundary planes of polycrystalline diamond of the light absorption layer are terminated with oxygen.

5. The transmission type photocathode according to claim 1, wherein the plane of emission of the light absorption layer is terminated with hydrogen.

6. The transmission type photocathode according to claim 1, wherein the plane of emission of the light absorption layer is terminated with oxygen.

7. The transmission type photocathode according to claim 1, wherein an active layer for lowering the work function of the light absorption layer is formed on the plane of emission of the light absorption layer.

8. The transmission type photocathode according to claim 7, wherein the active layer of the light absorption layer is formed of alkali metal, oxide of alkali metal or fluoride of alkali metal.

9. An electron tube comprising:

the transmission type photocathode according to claim 1;

an anode for directly or indirectly collecting the photoelectrons emitted from the transmission type photocathode; and an envelope in which the transmission type photocathode and the anode are accommodated.

10. The electron tube according to claim 9, further comprising electron multiplying means for multiplying the photoelectrons emitted from the transmission type photocathode to secondary electrons.

11. The electron tube according to claim 9, wherein the anode is formed of a fluorescent material which emits light upon incidence of electrons thereto.

12. The electron tube according to claim 9, further comprising a fluorescent material for emitting light upon incidence of electrons thereto, wherein the fluorescent material located at a position in the electron tube corresponding in position to an incident position of the light to be detected at the surface corresponding to the plane of incidence of the transmission type photocathode is made to emit light from the fluorescent material to thereby display an image.

* * * * *